US006691634B2

(12) United States Patent
Fritchle

(10) Patent No.: US 6,691,634 B2
(45) Date of Patent: Feb. 17, 2004

(54) BRAKING AND CONTROL DEVICE FOR PERSONAL WATERCRAFT

(76) Inventor: Daniel A. Fritchle, 321 Morningside Ter., Vista, CA (US) 92084

( * ) Notice: Subject to any disclaimer, the term of this patent is extended or adjusted under 35 U.S.C. 154(b) by 0 days.

(21) Appl. No.: 10/152,487

(22) Filed: May 21, 2002

(65) Prior Publication Data

US 2003/0217680 A1 Nov. 27, 2003

(51) Int. Cl.[7] ..... B63H 25/44
(52) U.S. Cl. ..... 114/145 R
(58) Field of Search ..... 114/144 R, 145 R, 114/146, 555

(56) References Cited

U.S. PATENT DOCUMENTS 5,813,357 A * 9/1998 Watson ..... 114/144 R
6,524,146 B2 * 2/2003 Spade et al. ..... 440/41

* cited by examiner

*Primary Examiner*—Ed Swinehart

(57) ABSTRACT

A braking and control mechanism for personal watercraft as described herein comprising a means for activation, by single lever FIG. 2, integrated into existing art steering assembly FIG. 12, a means for applying mechanical advantage from the cable assembly mechanism to the brake surface mechanisms, and a plurality of said brake surface mechanisms incorporating means for increasing deployment leverage and water flow impingement, said brake mechanisms providing a means to steer and slow the watercraft when deployed by individually or connectedly pivotally rotating from the watercraft ride plate into the water, thereby causing drag and rearward force on the watercraft.

7 Claims, 11 Drawing Sheets

BRAKING AND CONTROL DEVICE FOR PERSONAL WATERCRAFT

FEDERALLY SPONSORED RESEARCH

Not Applicable

SEQUENCE LISTING OR PROGRAM

Not Applicable

BACKGROUND

1. Field of Invention

This invention relates to a braking and steering device, specifically to provide braking and more particularly improved control capabilities for a personal watercraft such as a Waverunner®, Jet Ski®, SeaDoo®, or other such vessel.

2. Description of Prior Art

Currently more than one million personal watercraft, (PWC), are in use by individuals for recreation and boating enjoyment, resort and marina rental facilities, lifeguard and rescue organizations, and racing and entertainment entities. PWC employ a pump that receives water from an intake, pressurizes the water with rapidly spinning impeller blades, and expels the pressurized water through a nozzle or "jet". PWC are generally manufactured without braking or auxiliary control mechanisms, rely on propulsion for control (steering), and reduction of propulsion for slowing.

Inventors created several devices designed to improve control or braking characteristics of personal watercraft in such a way as to have minimal effect on slowing the vessel or significantly improving control. U.S. Pat. No. 5,092,260 to Mardikian (1992) discloses movable and fixed plate and drive shaft braking mechanisms; however movable/fixed plate devices may interfere with vessel trim, and operation of the hand lever may be exceedingly difficult. Drive shaft braking mechanisms are inherently ineffective due to the fact that once throttle is reduced, the pump intake water flow is significantly reduced, rendering drive shaft spin negligible for braking purposes. U.S. Pat. No. 5,193,478 also to Mardikian (1993) describes a trimming, steering and braking assembly that uses plates or flaps to independently or dependently slow or turn the watercraft. This particular design lacks effective angular position of the flaps relative to water-flow impedance, as well as not offering the advantageous mechanical advantage mechanism of present invention necessary to facilitate deployment of flaps. Another invention designed improve performance of PWC, U.S. Pat. No. 4,961,396 to Sasagawa (1990), proposes a trim plate adjusting device to optimize performance of the PWC under varying rider weight conditions. The trim plate application is unsuitable for improved control such as steering or slowing the forward momentum of a PWC.

Another invention designed for jet propelled watercraft, U.S. Pat. No. 5,934,954 to Schott et al. (1999), proposes a gate device that requires a volume of water to be flowing through the jet nozzle, potentially propelling the watercraft in forward motion, before the gate device will be effective.

A similar invention using a nozzle gate device to stop the watercraft, U.S. Pat. No. 5,755,601 to Jones (1998) utilizes an electronic controller and servo mechanism to actuate the cable mechanism and operate the gate. This invention again fails meet the need of applying a stopping or steering force to a watercraft minus the positive water flow through the jet nozzle.

Another invention based on the bucket or nozzle gate, U.S. Pat. No. 5,607,332 to Kobayashi et al. (1997), adds a foot pedal operation of the existing art nozzle gate concept Although the foot pedal design provides for a novel method of actuating a reverse bucket mechanism, it fails to address the problems inherent to the gate or bucket mechanisms, namely they require a volume of water to be propelled through the nozzle to have any effect.

Yet another invention designed for improved watercraft control, U.S. Patent Application 20010018300 to Spade (2001) relies on propulsion or jet flow, for control or braking, This device, while functional does not allow for any improved control or braking without positive water flow through the propulsion mechanism. This device also contains a multitude of claims and components, likely increasing the cost of installation and ownership over more straightforward designs. What this invention also fails to address are the riders who require control and braking without the application of throttle, or increasing power output through the jet nozzle.

These devices, as all braking devices heretofore, do not provide significant braking capabilities or noticeably improved control or turning without applied throttle, and suffer from a number of disadvantages:

(a) Movable/fixed plate devices are expensive to manufacture, require replacement of original manufacture equipment, have limited effect on slowing or stopping, and can potentially interfere with, or counteract the existing nozzle trim mechanisms available subsequent to 1992;

(b) Rigid assemblies are fixed and therefore difficult to adjust to varying conditions;

(c) Rigid, plate devices suffer from lack of independent side (left/right) control by the rider, preventing effective adjustment and control under normal and extreme riding conditions;

(d) Because of the nature of existing art in water intake and output in PWC, braking devices designed for drive shaft application do not noticeably improve braking capabilities, specifically when braking or steering is required without the application of throttle;

(e) Trim plate-type devices, although providing a level of improved hydrodynamics relating to angle of plane, are designed to facilitate water flow under the ride plate. Braking requires impedance of water flow to reduce speed, therefore reducing the effectiveness of these devices, and creating an increased level of difficulty pulling or operating the hand lever, while the plate device attempts to work against the flow of water.

(f) Control mechanisms which rely on any volume of water flowing from the jet nozzle for actuation of braking or steering, do not account for riders in the coasting (no water volume through jet) attitude, or riders who instinctively let off the throttle to dock or otherwise stop forward motion.

OBJECTS AND ADVANTAGES OF THE INVENITON

Primarily, present invention provides substantial improvement in rider and bystander safety by impeding the flow of water under the PWC ride plate thereby effectively slowing and braking of the PWC. Additionally, present invention provides steering capabilities to PWC with or without propulsion. It is thus the object of the present invention to provide a PWC rider/operator ability to significantly decrease stopping distance between another boat, person, object, other PWC, dock or other obstruction as well as to provide steering capability to avoid such objects and improve PWC performance.

It is another object of the present invention to allow steering, maneuvering and increased vessel control without jet propulsion or throttle engaged.

It is another object of the present invention to provide augmented steering control beyond existing art of jet nozzle control by actuating water-impeding paddles individually.

It is another object of the present invention to provide steering and braking capabilities when no throttle is applied to provide decreased risk of injury or death to rider or bystander;

Such a device provides a mechanism that is easy to use and actuate by means of hand levers and integrated steering control.

Advantageously, the present invention provides a device with increased reliability and resistance to elements.

As embodied and broadly described herein, the invention provides a device that can be actuated by riders/operators of all (legal) ages, by a variety of means including hand levers and steering.

It is another object of the present invention to allow for individual deployment of each braking control surface, facilitating steering with the throttle off.

It is another object of this invention to utilize many existing materials and assemblies familiar to those with knowledge of the art, thereby reducing the cost to manufacture, install, or purchase this invention over inventions of prior art.

Advantageously, each said braking control paddle surface can be deployed with the throttle engaged, thereby effectively enhancing maneuverability and steering performance characteristics of the watercraft while under power.

Additionally, each said braking device incorporates a series of angled ribs on the backside of each paddle, wherein said ribs increase the effectiveness of deployment by water flow force.

Further objects and advantages are to provide a device which can be used for braking, steering and control of a PWC whether or not it is under power, which is simple and instinctive to use, which significantly reduces stopping distance beyond current inventions, which is easy to maintain and operate, which is retractable in the "neutral" position, which contains rounded and safe surfaces, which requires no replacement of original manufactured equipment, and which obviates need for jumping off PWC in the event of potential collision. Still further objects and advantages will become apparent from a consideration of the ensuing description and drawings.

SUMMARY

In accordance with the present invention a braking device that comprises a combination manually actuated lever mechanism connected to a mechanical leveraging device, which engages a dual drop-down paddle braking mechanism, each brake surface mechanism containing means for increased water flow impingement and deployment facilitation, either (left or right) paddle capable of independent deployment, providing steering advantage and capability for a PWC.

It is another object of the present invention to provide control of speed and steering capabilities beyond the existing art when applied by the rider of PWC with no propulsion applied. Additionally, it is the object of present invention to increase performance and control of PWC by impeding water flow from the ride plate aft, under propulsion, thereby enhancing and augmenting steering and control capabilities of the PWC. Another object of present invention is to incorporate a mechanical advantage mechanism facilitating the lever operation and providing for maximum leverage in deployment of said brake surfaces.

Yet another object of present invention is to incorporate a series of angled ribs on the backside of each paddle surface, increasing the effectiveness of deployment by water flow force and leverage advantage during deployment of said braking surfaces.

It is further the object of the present invention to employ many mechanisms that are commonly available and familiar to those versed in the art, thereby reducing the cost to manufacture, install, or purchase the invention thereby providing wider access to the present invention than prior art.

DRAWINGS

Drawing Figures

REFERENCE NUMBERS IN DRAWINGS

Figure 1:
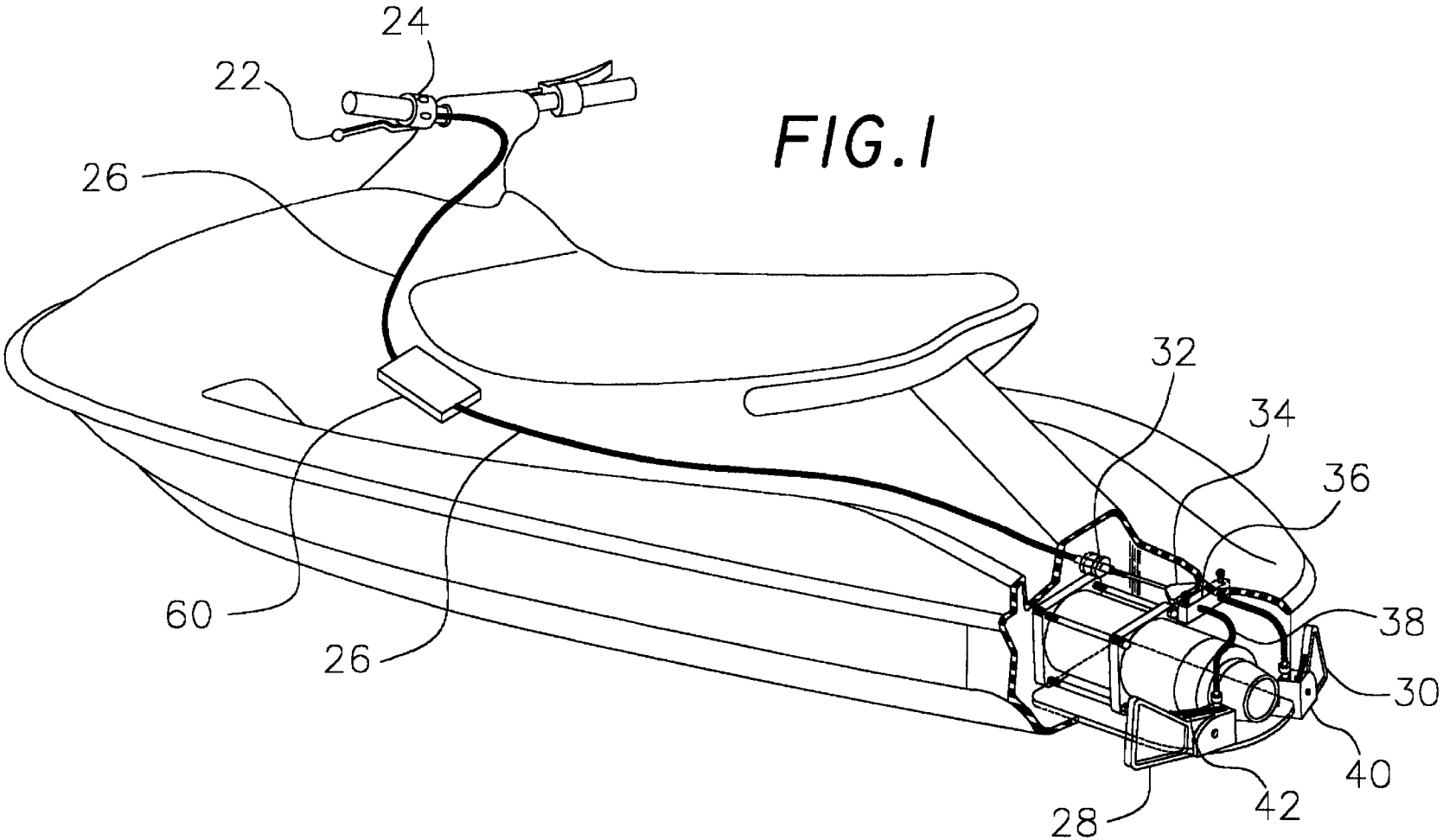
FIG. 1 shows invention in un-deployed position mounted on personal watercraft ride plate.

22 Hand control mechanism
24 Hand control pivot clamp and cable mount
26 Single forward actuator cable
28 Brake surface deployed
30 Brake surfaces retracted
32 Bulkhead cable through-hull fitting
34 Cable splitter block
36 Cable splitter mount
38 Rear dual actuator cables
40 Brake device paddle pivot housings
42 Rear paddle return springs
44 Ride plate surface
46 Cable splitter mounting bolts
48 Pivot housing cable connector bushings
50 Cable rotation pulley
52 Existing PWC handlebar assembly
54 Steering control actuator lever
56 Cable ball ends
58 Enhanced steering control mechanism
60 Mechanical advantage main housing plate hull mount
62 Throttle lever—prior art
64 Standard clevis connector
66 Mechanical advantage main housing plate
68 Dual cable mechanical advantage pivot arm
70 Cable housing attachment point
72 Cable splitter
74 Cable splitter main frame
76 Double acting cable captured pin slots
78 Augmented steering engagement activator
80 Clamp collar compression zone plate
82 Standard marine grade flexible cable
84 Existing PWC main steering post
86 Captivated floating cables
88 Lever activated engagement clamp collar
90 Clamp collar pivot point
92 Brake surface showing angled ribs

DETAILED DESCRIPTION

Figure 2:
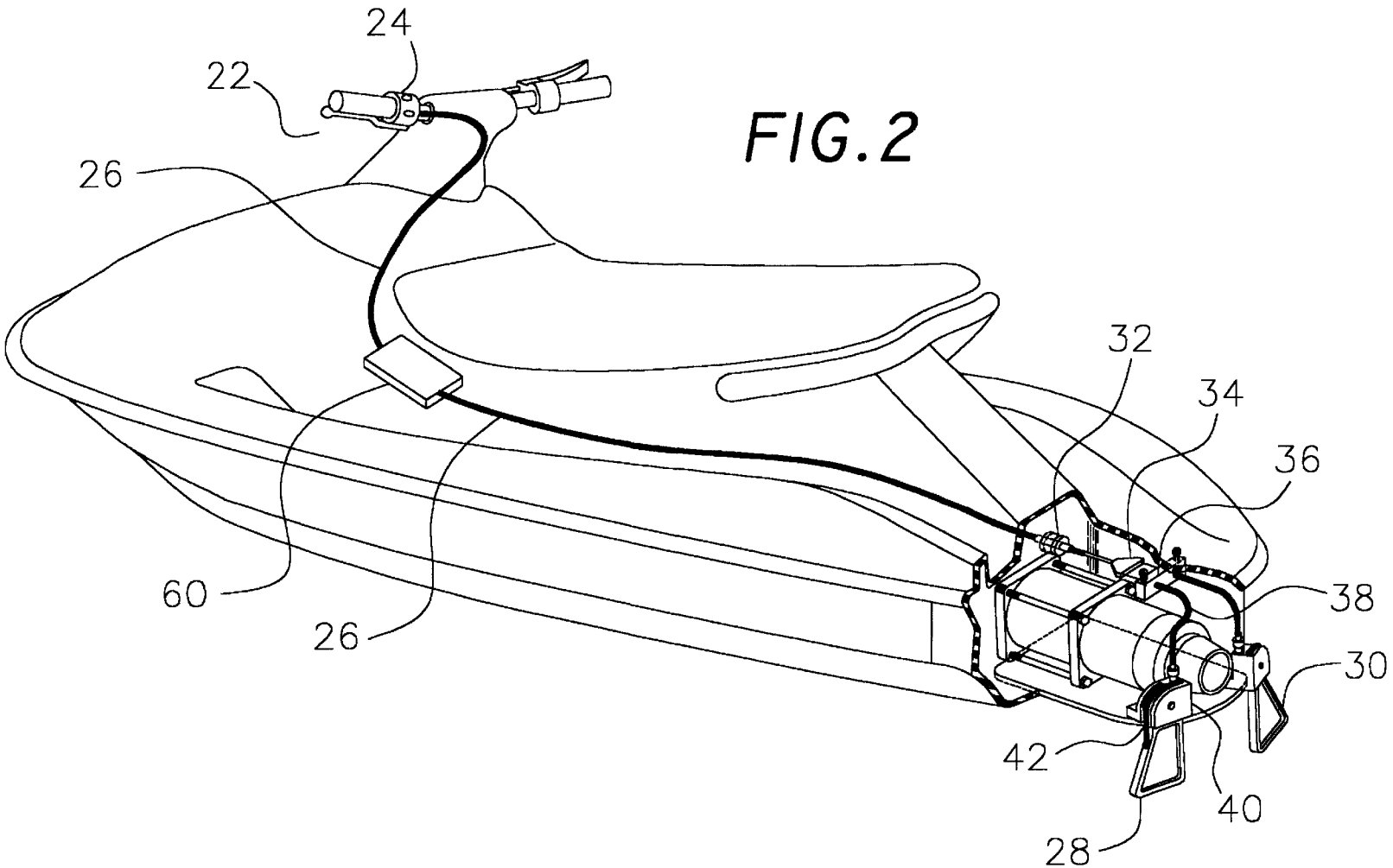
FIG. 2 shows invention in deployed position mounted on personal watercraft ride plate.

Description-FIGS. 1, 2, 3, 4, 5, 6, 7, 9, 10, 12-Prefered Embodiment A preferred embodiment of the braking device of the present invention is illustrated in FIG. 1 (un-deployed view) and FIG. 2 (deployed view) wherein the rider activates the braking mechanism by pulling a hand lever 22. The control device consists of a hand-operated actuating mechanism 22, 24 and 26, which activates a single forward actuator cable 26 running to a mechanical advantage main housing plate hull mount 62 and mechanism 60 and to rear control surface paddles 28 and 30. In the preferred embodiment, the hand mechanism and the control surface paddles are comprised of machined aluminum, but can consist of any rigid material that can be shaped to conform to the required configuration, and withstand exposure to elements, including fresh water, salt water, sand, mud, sunlight, hot and cold temperatures, and applied pressure. Other materials include stainless steel, carbon fiber, nylon, hardened rubber, graphite composite, various plasticized products, or other metal products.

Figure 3:
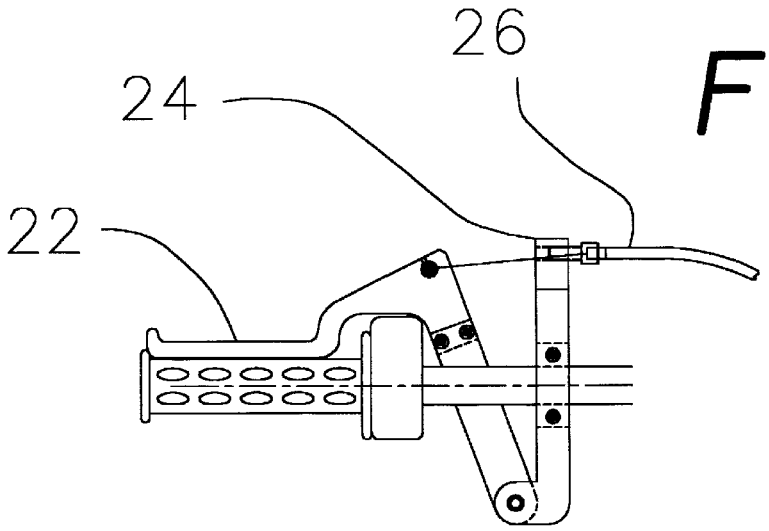
FIG. 3 shows deployed hand-actuated mechanism providing mechanical advantage and necessary cable travel.
Figure 4:
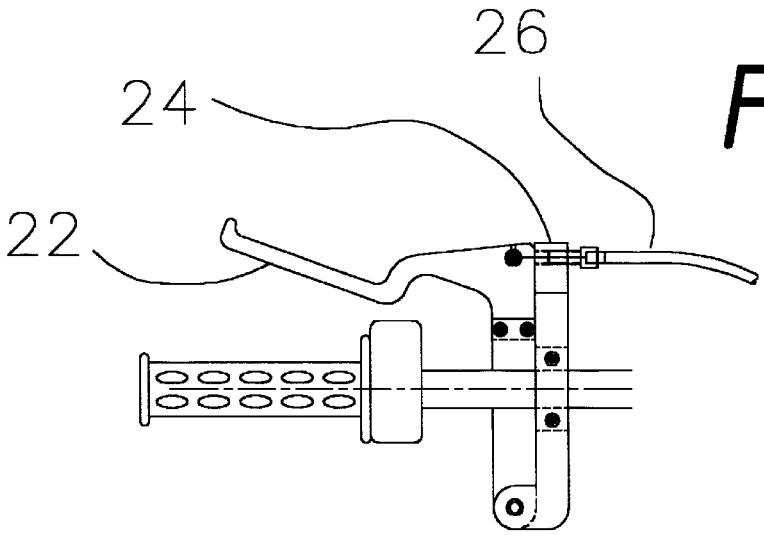
FIG. 4 shows hand-actuated mechanism designed for rider ergonomics at rest in un-deployed position.
Figure 5:
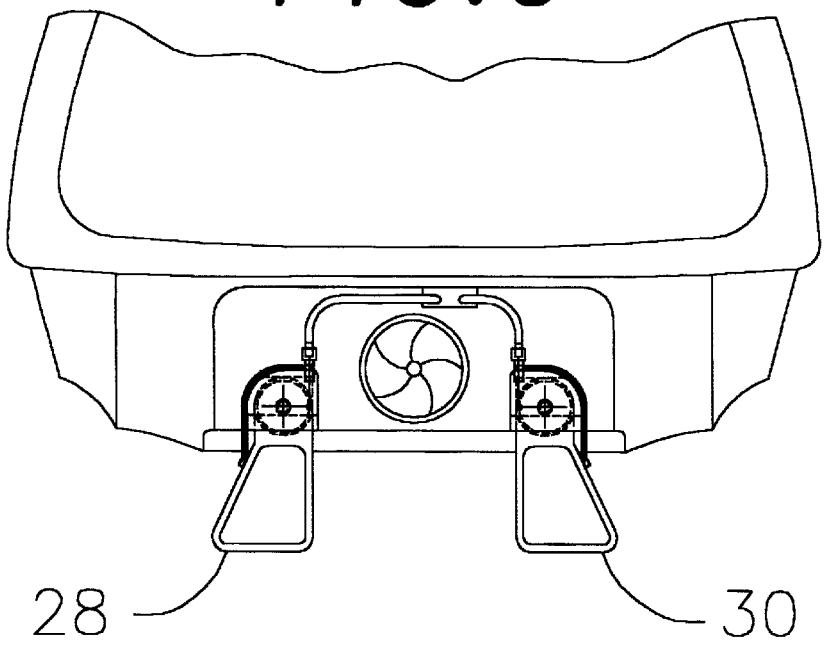
FIG. 5 shows braking mechanism surfaces deployed as mounted on personal watercraft ride plate.
Figure 6:
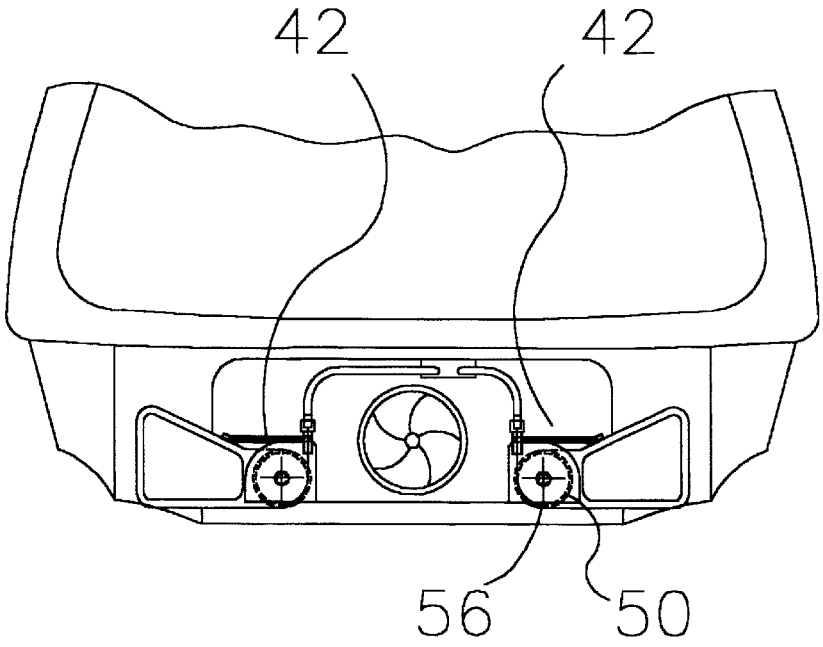
FIG. 6 shows braking mechanism surfaces in neutral as mounted on personal watercraft ride plate.

The hand actuator mechanism 22 provides a twenty degree movement at the point of actuation to the cable assembly illustrated FIG. 3 thereby increasing the effective travel on the rear control paddles 28, 30 as shown in FIG. 5. At rest, or in the un-deployed position, shown in FIG. 4 and FIG. 6, the hand lever and control paddles return to a retracted position by means of retracting springs 42. The hand actuator is mounted on the left handlebar of the PWC by means of a hand control pivot clamp and cable mount 24. The hand actuator is connected to the rear assembly by means of a housed cable 26.

Figure 12:
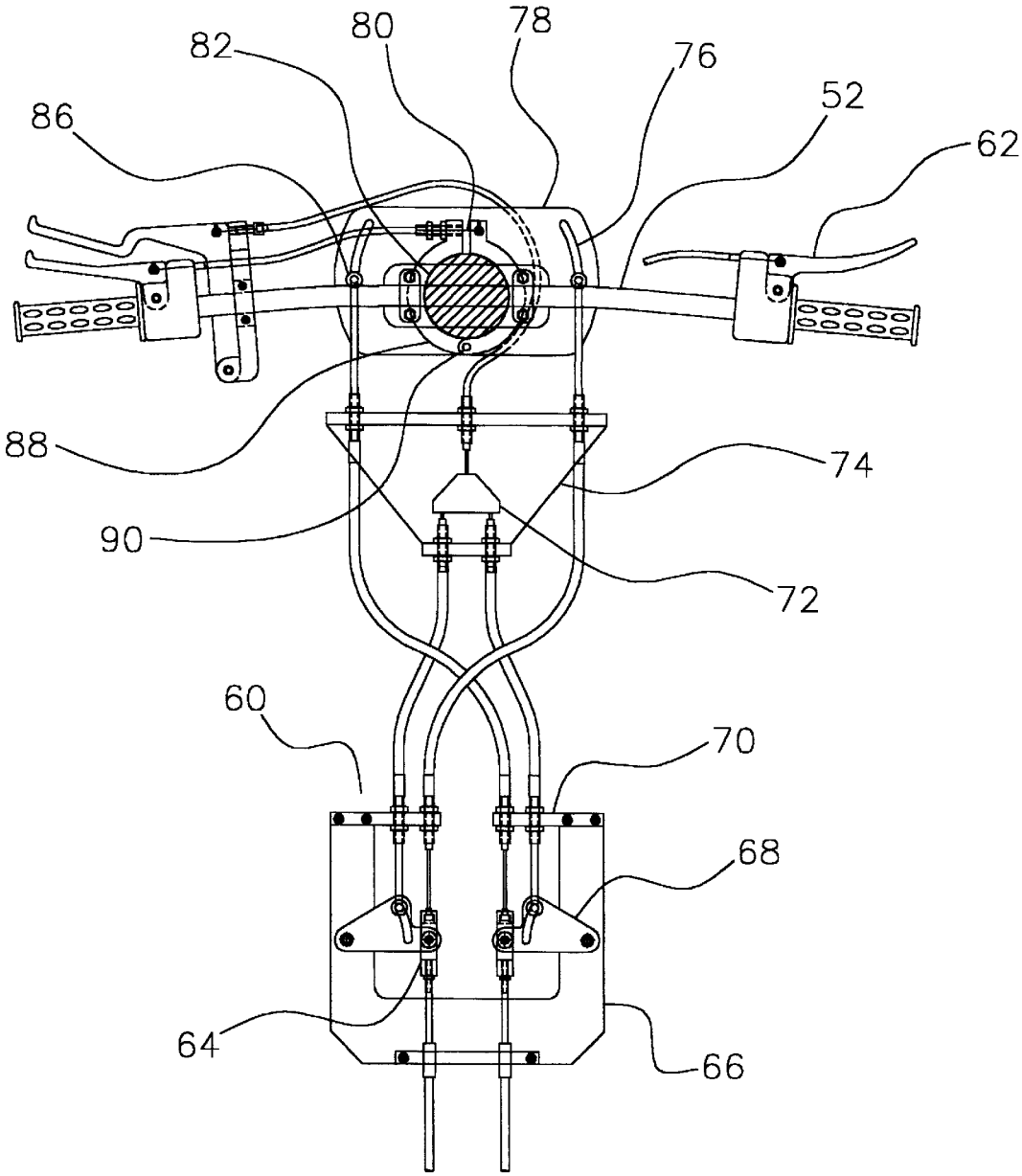
FIG. 12 shows the hull mount cable and lever system, which enhances the mechanical advantage of transfer of force from the actuator levers to control surfaces in such a way as to allow easy deployment of braking and steering paddle control surfaces with maximum force.

In FIG. 12, invention contains said mechanical advantage main housing 60, which enhances the mechanical advantage of transfer of force from the actuator levers to control surfaces in such a way as to allow easy deployment of levers with maximum force exerted on the brake control surfaces by means of cable mechanical advantage pivot arms 68.

Figure 7:
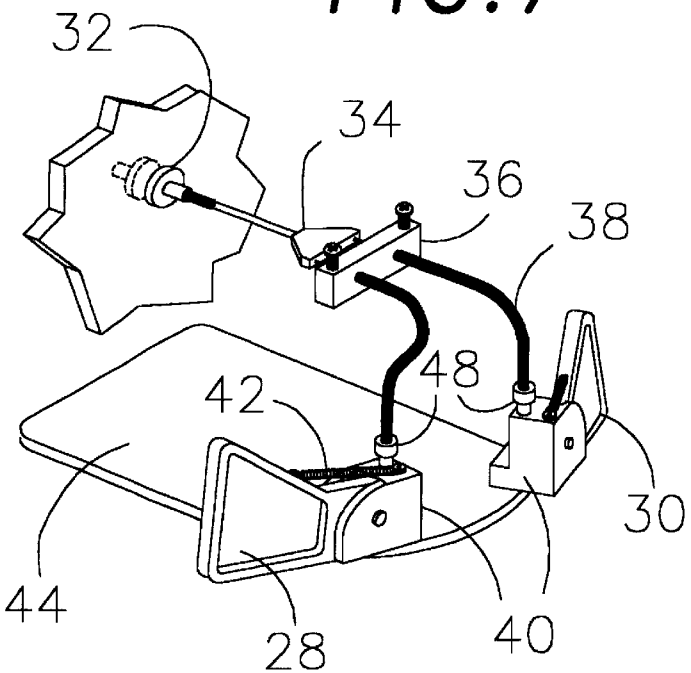
FIG. 7 shows cutaway of cable splitter design, where single front cable exits rear PWC transom by way of bulkhead fitting and is integrated into a splitting device, converting the single cable into two cable housings, enabling the actuation of both braking mechanism.
Figure 9:
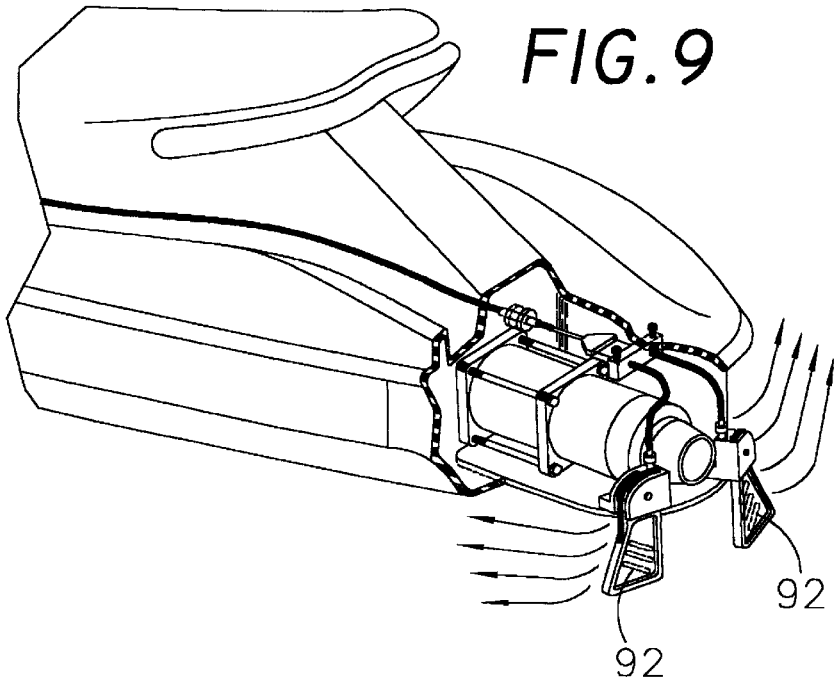
FIG. 9 shows close view of deployed braking mechanisms, return springs extended, cable splitter, and inside bulkhead mount bushing showing water flow direction.
Figure 10:
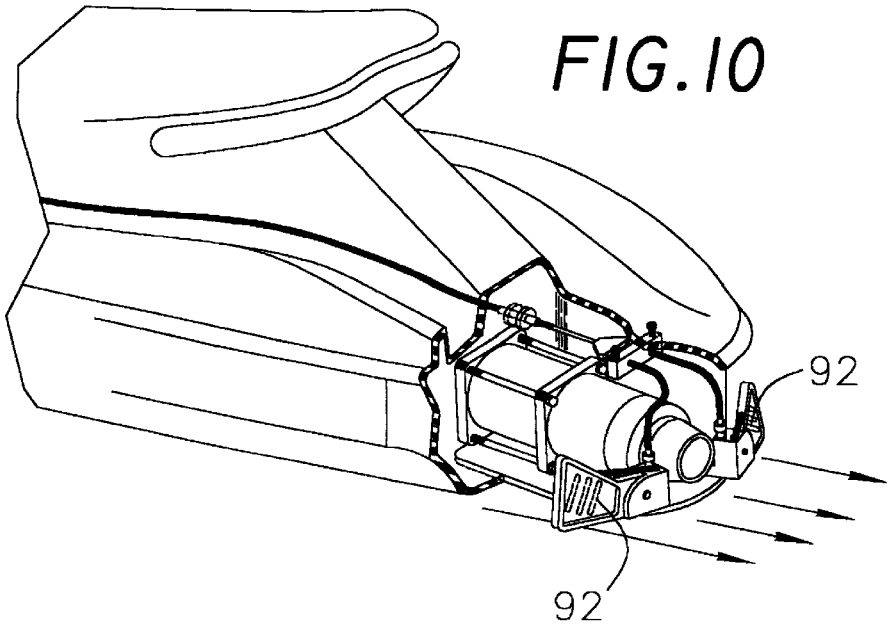
FIG. 10 shows retracted braking mechanisms, return springs retracted, resting cable splitter, and inner hull mount bushing showing water flow direction.

The rear cable assembly of the invention as shown in FIG. 7 connects to the forward actuating mechanism by means of a housed control cable 82, whereby the single cable 26 runs through the inside of PWC body to the mechanical advantage main housing plate hull mount 60, and exits the rear transom of the PWC by means of a standard bulkhead through-fitting 32. The through-fitting provides for a means of passing the cable through the PWC hull, without binding or obstructing the movement of the cable, and providing for a watertight seal. The single cable is fixed to a cable splitter mechanism 34 in the rear of the PWC comprised of machined aluminum and affixed to a secondary set of rear-mounted cables 38, which are of stainless steel and friction-reducing material construction.

A cable splitter mount 36 comprised of machined aluminum or other suitable material secures the cable splitter mechanism 34 to the hull of the PWC by means of mounting screws 46 comprised of stainless steel or other corrosion-resistant material. The cable splitter mount further allows the rear dual actuator cables to terminate and connect to the single forward actuator cable by means of the cable splitter mechanism. In other embodiments, the rear dual actuator cables may pass through the cable splitter mount without mating with the cable splitter mechanism, utilizing two bulkhead through-hull fittings and two independently operated control mechanisms allowing each of the brake surfaces to deploy independent of one another.

Rear actuator control cables for augmented steering control 38, commonly comprised of flexible stainless steel outer housings, which insert into the pivot housing cable bushings 48, allowing the control cable 38 to pass into and be mounted to the brake device cable rotating pulley 50 by means of cable ball ends 56. In the un-deployed position FIG. 7, FIG. 3, forward 26 and rear cables 38 are at rest with the brake surfaces 30 retracted by means of rear paddle return springs 42. Said return springs are comprised of stainless steel or other common corrosion-resistant material, and are fixed to the top edge of the brake surface and top of the pivot housings 40 by means of standard mounting screws.

Brake surfaces 28, 30 are comprised of machined aluminum or other common corrosion-resistant material and fixed to brake device pivot housings 40 in such a way as to allow the brake devices to pivot by means of cable tension or return spring tension. Brake device pivot housings are mounted to the PWC common ride plate 44 by means of common corrosion-resistant bolts. The brake surfaces are of a size that will provide a reduction of PWC water flow and forward momentum when deployed FIG. 9, and while in the retracted position FIG. 10 do not interfere with the normal forward water low and momentum of the PWC. The rear surface area of each braking paddle incorporates a series of angled ribs 92 increasing the effectiveness of deployment by water flow force and leverage advantage during deployment of said braking surfaces.

Figure 11:
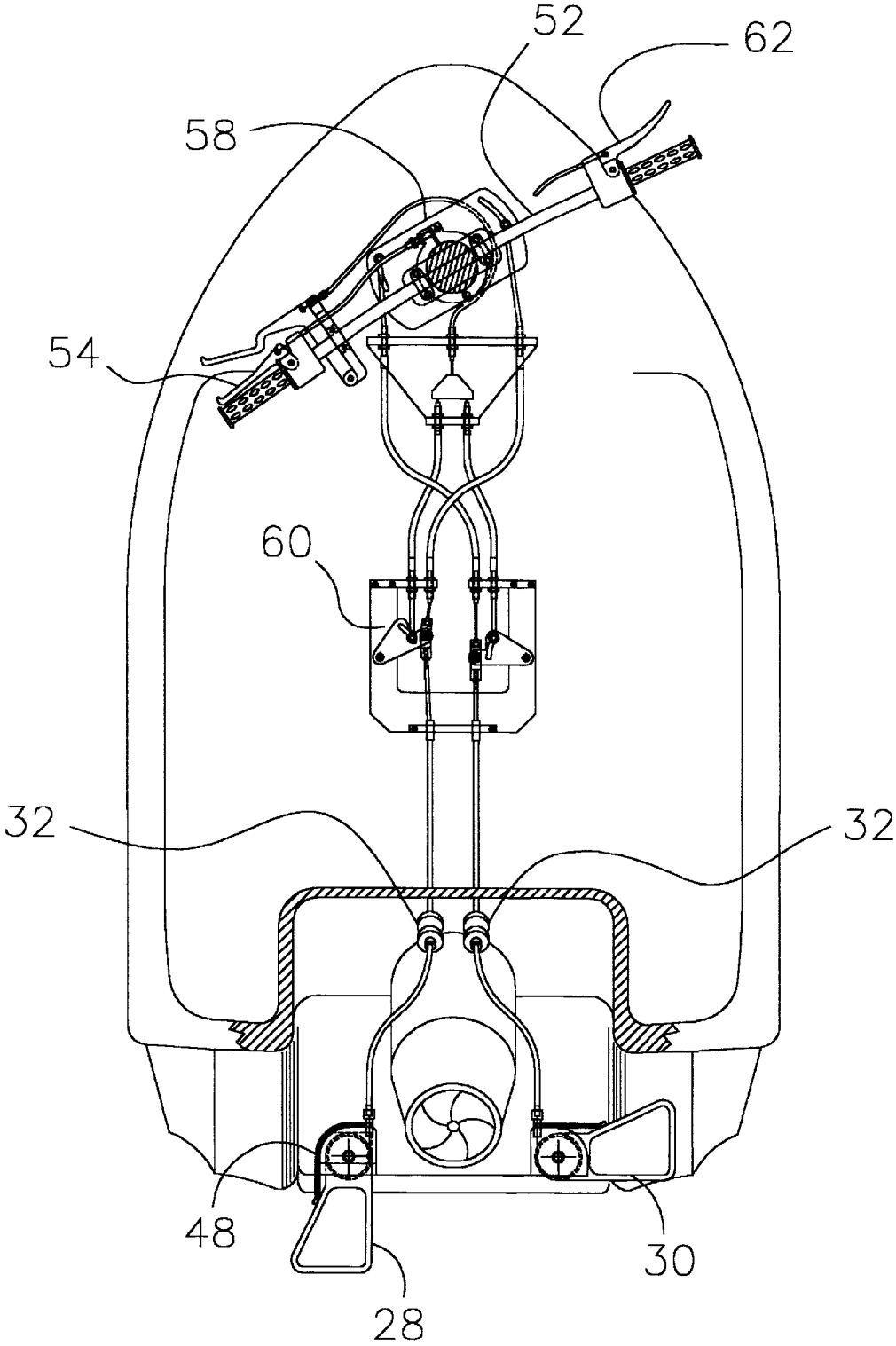
FIG. 11 shows means to engage synchronized control surface deployment by means of steering the PWC handlebars for turning left.

FIG. 11-Additional Embodiments

Additional embodiments are shown in FIG. 11, where each of the brake surfaces may be deployed independently by means of hand controls. This embodiment requires the addition of an enhanced steering control mechanism 58 and additional bulkhead through-hull fitting 32. Also required for this embodiment is the elimination of the cable splitter mechanism 34. This embodiment allows the rider to steer the PWC when coasting, when no power is applied, and no water flowing through the jet nozzle.

FIG. 12-Alternative Embodiments

There are various possibilities with regard to the composition of materials, placement of clamps and actuating devices, cable type, lever type, mounting hardware, paddle size and means of actuating the brake surfaces so as to slow, stop or facilitate steering for the rider of the PWC.

One variation of the embodiment shown in FIG. 12 is integrated steering, wherein the steering devices are controlled through the steering movement of the existing handlebars, and the brake function is hand controlled. This simplifies the operation for the rider, eliminates additional hand controls, and includes an enhanced steering control mechanism 58, a mechanical advantage main housing mechanism 60, augmented steering engagement activator plate 78, as well as most components in aforementioned preferred embodiment.

Advantages

Figure 8:
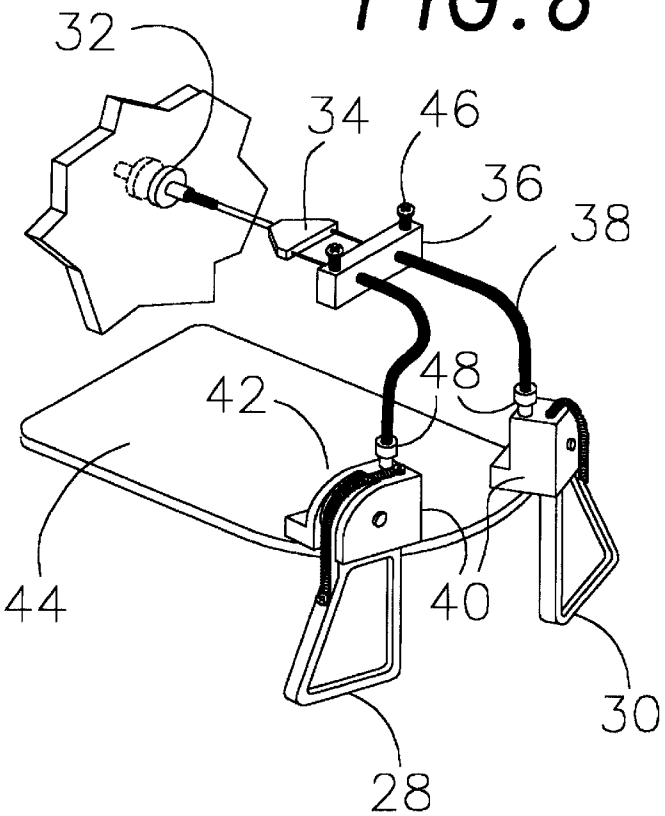
FIG. 8 shows cutaway of cable splitter design, where single front cable exits rear PWC transom by way of bulkhead through-hull fitting and is integrated into a splitting device, converting the single cable into two cable housings, with braking mechanisms deployed.
Figure 14:
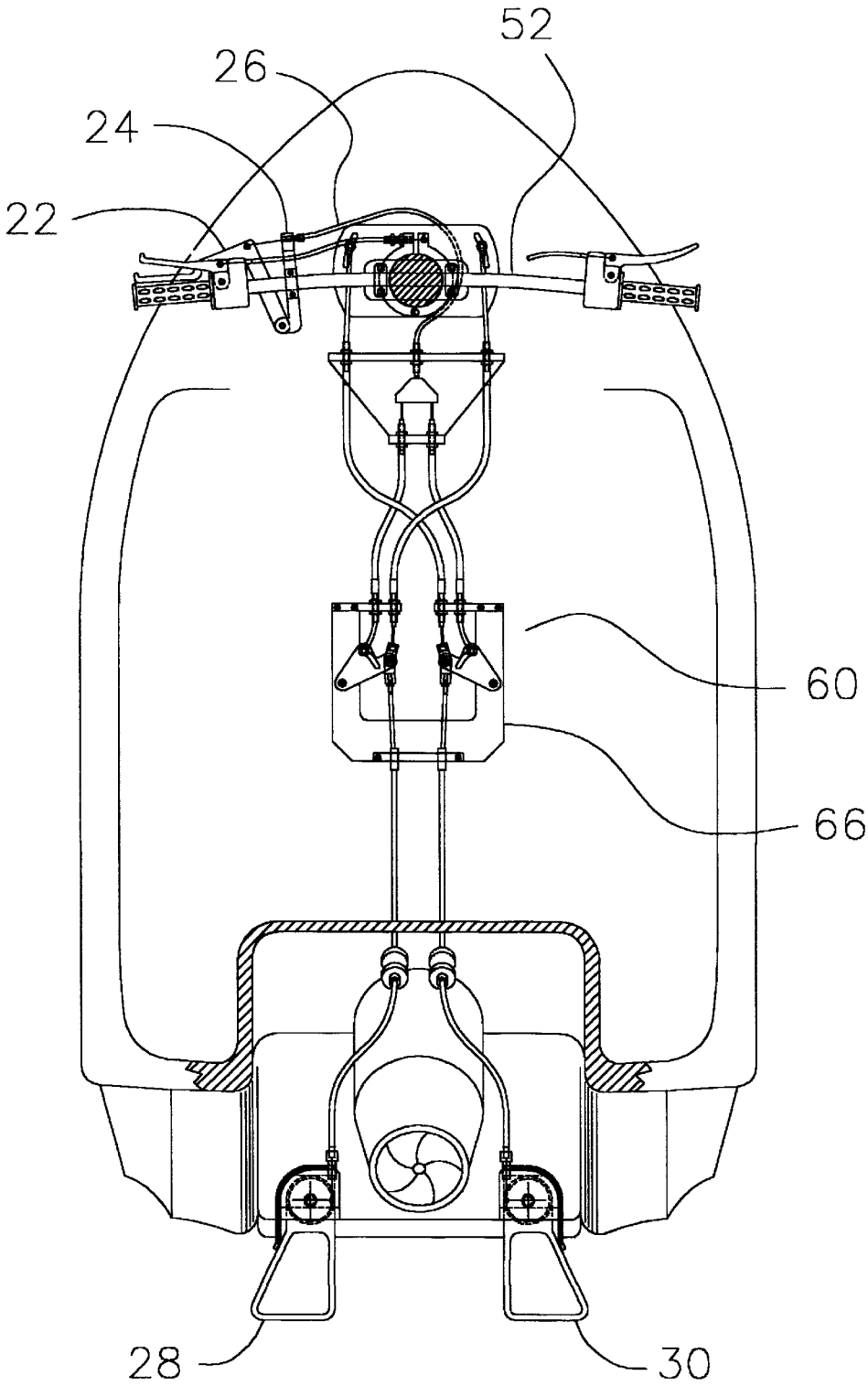
FIG. 14 shows brake deployment in fully engaged position.
Figure 15:
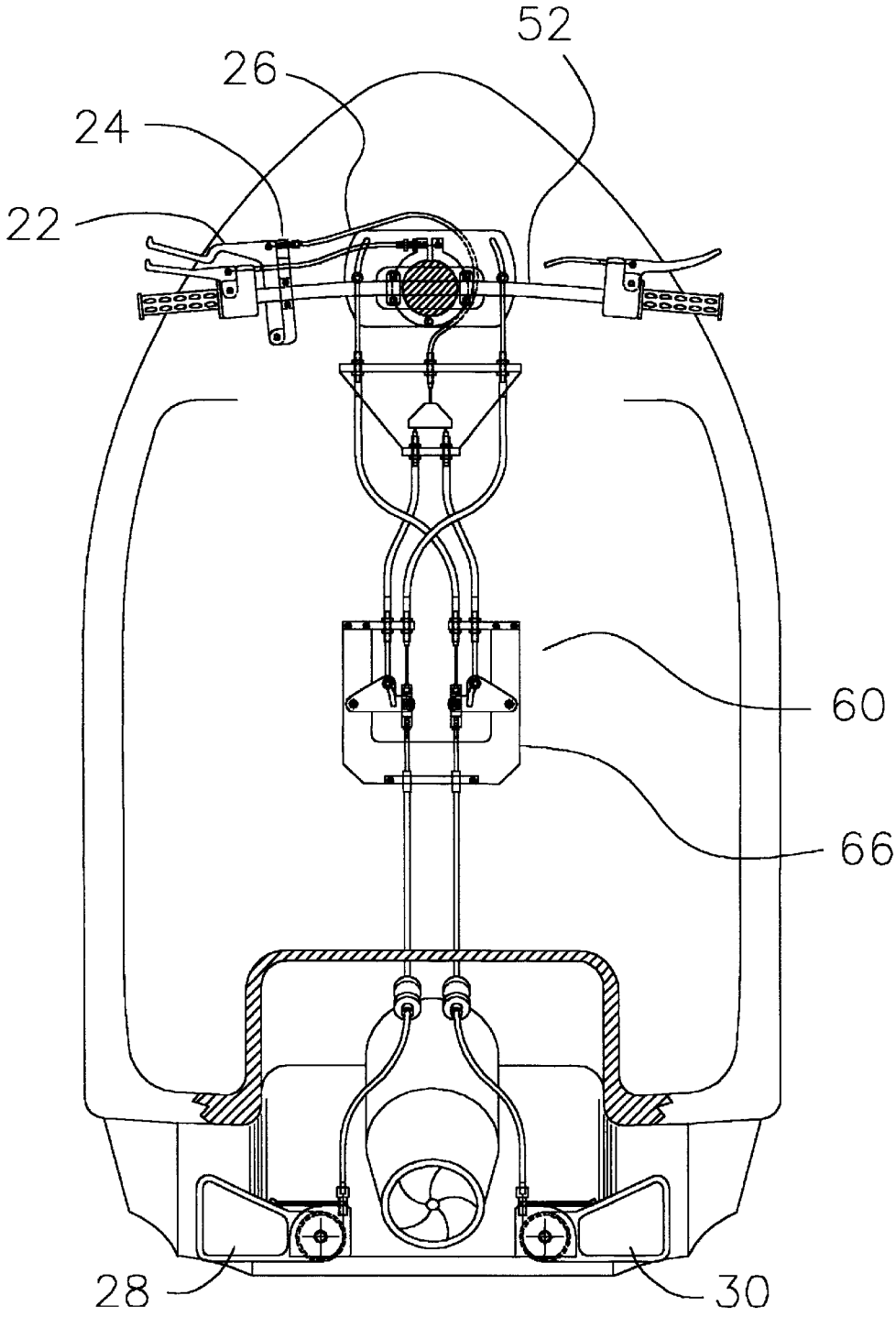
FIG. 15 shows brake and steering control surfaces fully retracted in the neural position.

From the description above, a number of advantages of my braking and control device for PWC become evident over prior art:

a) The vertical alignment of the brake surfaces provide effective impedance to the ride plate water flow, generating an approximate seventy percent increase in braking power over the simple reduction or elimination of throttle.

b) Ridges on the brake surfaces create a cupping action increasing the amount of water flow impingement and providing leverage to facilitate deployment of said braking surfaces.

c) The retractable nature of the brake surfaces remove water flow impedance when in the retracted position, allowing the full performance characteristics of any PWC to be employed, and reducing the risk of injury to the rider.

d) Additional advantages of the retracting brake surfaces include reduced risk of damage to the units when trailering or beaching the watercraft.

e) The nature if the invention allows for either original factory installation of the invention or as an aftermarket addition to PWC already in use.

f) Configuration of braking control surfaces as described herein provides for enhanced control of PWC, without compromising the performance of the watercraft. The nature of the braking control surfaces allows deployment of a single surface for turning, or both surfaces simultaneously for braking, without causing the PWC to unduly dive or otherwise loose originally designed performance integrity.

g) The hull mount cable lever system as described herein enhances the mechanical advantage of transfer of force from the actuator levers to control surfaces in such a way as to allow easy deployment of paddles with maximum force exerted on the brake control surfaces.

h) Integrated steering control, as described herein, facilitates ease of operation combined with enhanced performance characteristics of the PWC.

i) The employment of many common mechanisms in this invention familiar to those versed in the art facilitates operation, installation, and reduction of cost to manufacture. Operation—FIGS. 3, 4, 7, 8, 11, 14, The manner of operating the braking and control device to slow or stop a PWC is almost identical to the operation of brake devices in present use on bicycles and motorcycles. Namely, the rider, in a seated or upright position, pulls on the hand actuating lever FIG. 3 to achieve deployment of the brake control surfaces FIG. 5, while releasing the prior art throttle lever 62. By pulling on the hand-actuating lever 22, the rider creates tension on the forward cable assembly 26. Said cable assembly exerts force on the hull mount cable lever mechanism FIG. 14, creating a mechanical advantage delivered to, and deploying, said braking control surfaces FIG. 8. To release the brakes, the rider releases the hand-actuating lever FIG. 4, thereby releasing tension of said forward cable and hull mount cable mechanism respectively, returning the brake control surfaces to the retracted or un-deployed position FIG. 7 by means of rear paddle return springs 42.

Alternatively, as shown in FIG. 11, the rider may deploy said brake control surfaces by said means of a single hand lever, and independently deploy the integrated steering mechanism by means of a separate lever 54. In this embodiment, the rider can choose to deploy both said brake control surface simultaneously by means of said hand actuating lever, or deploy said integrated steering mechanism by means of a smaller lever mounted on the same handlebar FIG. 11 allowing the handlebar steering to actuate each brake, or steering, control surface independently.

Figure 13:
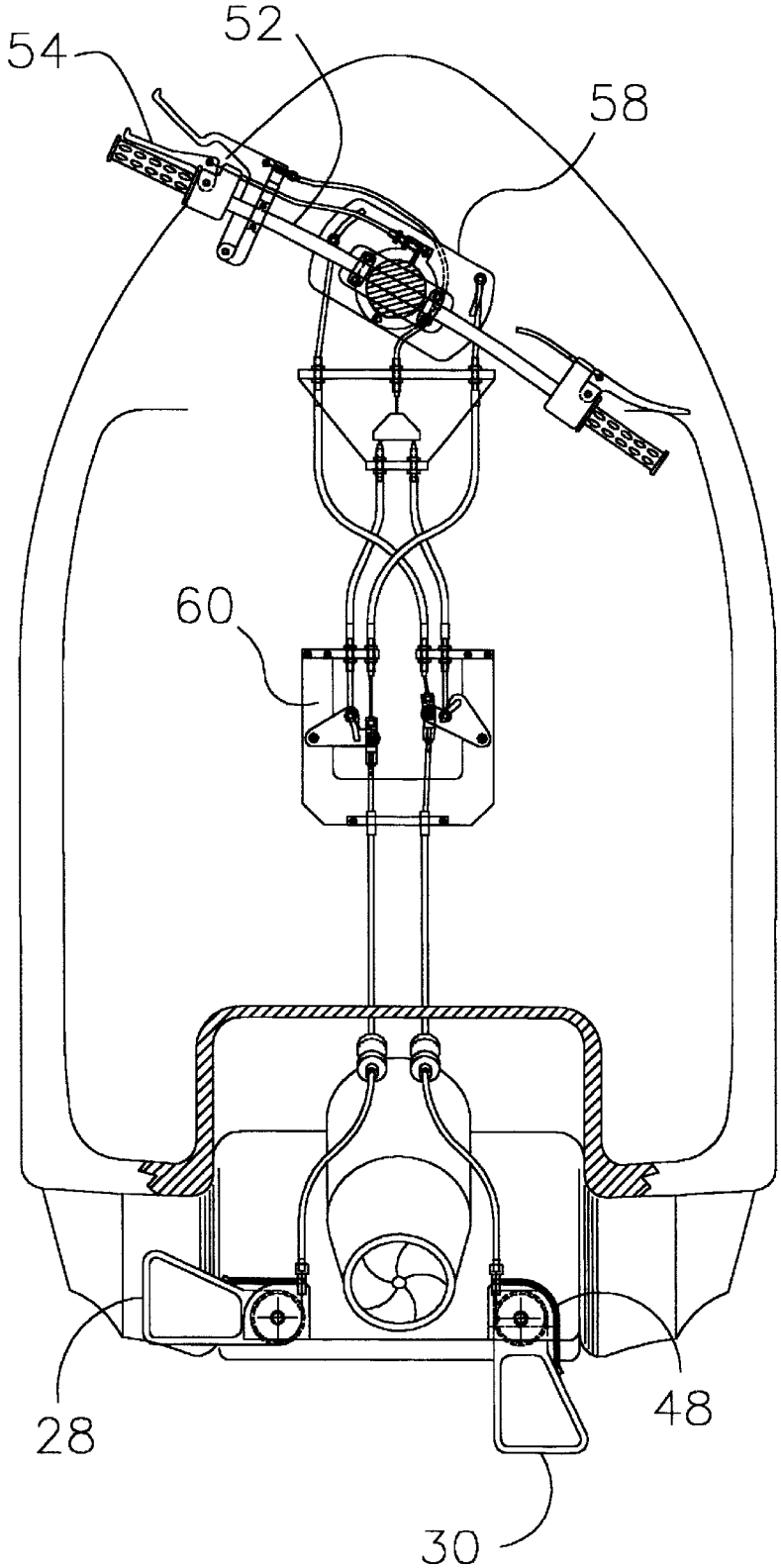
FIG. 13 shows means to engage synchronous control surface deployment by means of steering the PWC handlebars for right turning.

In order to fully understand and appreciate the benefits of one embodiment of present invention wherein deploying the integrated steering mechanism FIG. 13, the operator, with or without throttle applied, pulls the steering control actuator lever 54, which in turn pulls the single forward actuator cable 26 engaging the enhanced steering control mechanism 58 and the steering paddle engagement plate 52 therein. The enhanced steering control mechanism incorporates several advantageous means to transfer steering control from the existing PWC handlebar assembly 52, and existing PWC main steering post 84 to the said brake surfaces 28, 30. As the said steering actuator lever is pulled, said actuator cable engages the lever activated engagement clamp collar 88 containing means for clamping to said main steering post with clamp collar pivot pin 90 and clamp collar compression zone 80. Engaged, said integrated steering mechanism provides means for individual deployment of said brake surfaces by turning the augmented steering engagement actuator plate 78 containing double acting cable captured pin slots 76, thereby engaging one of two captivated floating cables 86 by means of said captured pin slots and allowing the other of two said captivated floating cables to float or rest in the un-deployed position.

When said captivated floating cables 86 contained within standard marine grade flexible cable 82 are engaged, the energy or pull is transferred to said mechanical advantage main housing 66 by means of a cable splitter main frame 74 assembly and a cable splitter 72, whereby said single forward actuator cable 26 is separated into two cables by means of said cable splitter. Both cables attach to the hull mount cable lever system 60 containing means for applying mechanical advantage through the cable housing attachment point 70 and terminate via standard clevis connectors 64 on the dual cable mechanical advantage pivot arm 68 attached to said mechanical advantage main housing plate 66.

When engaged, said pivot arms 68 pivot and engage rear standard marine grade flexible cables by means of standard clevis connectors. Rear cables attach to said mechanical advantage main housing plate by means of said cable housing attachment points and exit the inner PWC hull by means of bulkhead cable through-hull fittings 32 whereby said rear cables connect to brake device paddle pivot housings 40 by means of pivot housing cable connector bushings 48. Said brake device paddle pivot housings connect to the PWC existing ride plate surface 44 by means of standard bolts and contain the cable rotation pulley 50, rear paddle. return springs 42, cable ball ends 56, and said brake surfaces 28, 30, providing means for independent deployment and retraction of said brake surfaces. Ribs incorporated into said rear brake surfaces 92 create a cupping action increasing the effectiveness of deployment by water flow force and leverage advantage during deployment of said braking surfaces.

Conclusion, Ramifications, and Scope

Accordingly, the reader will see that the braking and control device of this invention can be used to brake PWC with or without propulsion, can be used to steer PWC with or without propulsion, enhance the steering and performance characteristics of PWC, and provide control and safety improvements previously unavailable for PWC.

In addition, this invention can be factory installed by the manufacturer, or by an authorized technician as a safety or control accessory.

Furthermore, the invention has the additional advantages in that:

It is instinctive and easy to operate;

It is made of superior, corrosion-resistant materials that improve reliability,

It can be easily installed and maintained, by manufacturer or rider;

It can be deployed effectively under varying propulsion and coasting environments;

It is unobtrusive, in that it is retractable;

It will not interfere with the newer generation PWC that contain a jet nozzle that serves to propel, steer and trim the watercraft;

It will supplement and augment the capabilities of newer generation PWC that contain a jet nozzle that serves to propel, steer and trim the watercraft;

The hull mount cable lever mechanism provides mechanical advantage for ease of operation, and effective use of energy in deployment of braking and steering surfaces;

It allows the operator to slow the vessel, as required, under a variety of conditions;

In several embodiments, it allows for several different configurations and capabilities, including hand actuated steering and braking and integrated handlebar steering;

The incorporated ridges on the braking surfaces facilitate deployment, increase water flow impingement, and increase steering and braking performance characteristics;

Integrated handlebar steering provides a highly-simplified means of enhancing a PWC's performance characteristics;

It offers the potential to increase the safety factor of PWC in general.

Employing common levers, cables and fittings reduce the cost of manufacture, ownership, and increases user familiarity for those versed in the art.

The above description contains many specifics, which should not be construed as limiting the scope of the invention but as merely providing illustrations of some presently preferred embodiments of this invention. For example, the hand levers can take other shapes or forms, the actuating mechanism can be modified, shortened or lengthened, and the paddles may take other shapes and sizes including multiple surfaces.

Thus the scope of this invention should be determined by the claims herein and their legal equivalents, rather than by the examples given herein.

I claim:

1. A braking and control device for watercraft comprising of: (a) handlebar-mounted hand lever (s); (b) a linking member; (c) a system providing means for obtaining mechanical advantage; (d) a linking member system whereby one control member is split into a plurality of control members; (e) means for mounting a plurality of water-impinging devices, thereby allowing for deployment of said impinging devices; (f) a plurality of impinging devices mounted on a watercraft stern or ride plate wherein each said device is capable of independent deployment from a retracted position to a water flow impingement position when said watercraft is in either forward or reverse motion, thereby creating a volume of water to impinge on said device when deployed, creating drag and resistance, effectively slowing, stopping, or steering said watercraft.

2. A control and braking device for watercraft as recited in claim 1, further comprising of a control splitter mount supporting a control linking system containing means for a single hand lever to actuate a single or plurality of control devices.

3. A control and braking device for a watercraft as recited in claim 1, further comprising of means for obtaining mechanical advantage with the use of hydraulics or pivot fulcrum leverage of which provides means for reducing the force required to actuate said impinging devices from the inoperative to operative position.

4. A braking and control device for watercraft as recited in claim 1, further comprising of water flow impinging devices that incorporate means for increased deployment leverage and increased water flow impingement.

5. A control and braking device for watercraft as recited in claim 2, further comprising of a steering control member linking system to independently apply a force to a plurality of control members.

6. A control and braking device for watercraft as recited in claim 5, further comprising of means for attaching to, and releasing from, the existing watercraft main steering post under operator control.

7. A control and braking device for watercraft as recited in claim 3, further comprising of means for applying mechanical advantage from the hand operated mechanism by means of a single control member connected to a means for transferring a single control member into a plurality of control members connected to a means for providing increased leverage applied to a plurality of impinging devices.

* * * * *